United States Patent [19]

Smith et al.

[11] Patent Number: 4,881,983

[45] Date of Patent: Nov. 21, 1989

[54] MANUFACTURE OF CORROSION RESISTANT COMPONENTS

[75] Inventors: John D. Smith, Solihull; Stephen E. Vanes, Hall Green, both of United Kingdom

[73] Assignee: Lucas Industries Public Limited Company, Birmingham, England

[21] Appl. No.: 215,563

[22] Filed: Jul. 6, 1988

[30] Foreign Application Priority Data

Jul. 17, 1987 [GB] United Kingdom ..... 8716928

[51] Int. Cl.[4] ..... C23C 8/34; C23C 11/08

[52] U.S. Cl. ..... 148/16.6; 148/277

[58] Field of Search ..... 148/16.6, 6.35

[56] References Cited

U.S. PATENT DOCUMENTS

| | | | |
|---|---|---|---|
| 4,035,200 | 7/1977 | Valentijn | 148/6.35 |
| 4,131,492 | 12/1978 | Fushimi et al. | 148/16.6 |
| 4,448,612 | 5/1984 | Ebert et al. | 148/6.35 |
| 4,496,401 | 1/1985 | Dawes et al. | 148/16.6 |
| 4,596,611 | 6/1986 | Dawes et al. | 148/16.5 |
| 4,702,779 | 10/1987 | Madsac et al. | 148/16.6 |

FOREIGN PATENT DOCUMENTS

| | | | |
|---|---|---|---|
| 2560892 | 9/1985 | France | 148/16.6 |
| 2180264 | 3/1987 | United Kingdom | 148/16.6 |

*Primary Examiner*—Upendra Roy

*Attorney, Agent, or Firm*—Nixon & Vanderhye

[57] ABSTRACT

A steel component is provided with a black wear and corrosion resistant finish by the steps of forming an epsilon iron nitride or carbonitride layer, bringing the component to gas oxidation temperature and oxidizing by a gaseous medium to form a dense black coating, and carrying out a surface finish treatment.

12 Claims, No Drawings

MANUFACTURE OF CORROSION RESISTANT COMPONENTS

BACKGROUND OF THE INVENTION

The invention relates to the manufacture of corrosion resistant steel components, and in particular to such components which have an aesthetically pleasing uniform dense black finish.

It is known from eg. U.S. 4,496,401 to form a corrosion resistant epsilon iron nitride or carbonitride layer on an alloy steel component. According to GB-A-2180264 the treated layer is given a mechanical surface finish, followed by a gaseous oxidation to provide an oxide-rich surface layer.

The invention is based on the realisation that if a component having a selected surface layer is subjected to predetermined gaseous oxidation followed by a predetermined surface preparation treatment the component is provided with both corrosion resistance and an aesthetically pleasing black appearance. Further, such a component may be used without the need for a further coating e.g. a wax sealant or paint or a film of oil.

SUMMARY OF THE INVENTION

Accordingly, in one aspect, the invention provides a method of manufacturing a corrosion resistant steel component comprising forming an epsilon iron nitride or carbonitride surface layer on the component, and then applying a surface finish followed by oxidation characterised in that after the surface layer is formed the component is brought to a gas oxidation temperature and oxidised by a gaseous oxidation medium to form a dense black coating which comprises $Fe_3O_4$ and then carrying out a surface finish treatment.

It is an advantageous feature of this invention that the heat treatment stages of the method can be performed in immediate succession in the same treatment vessel.

In one preferred aspect of the invention the nitriding or nitrocarburising is carried out in a treatment vessel therefor at a nitriding or nitrocarburising temperature, and on completion of this stage, the temperature is adjusted to a gaseous oxidation temperature and gaseous oxidation is then carried out in the same vessel. Preferably after the nitriding or nitrocarburising, the vessel is purged of the nitriding or nitrocarburising atmosphere, filled with an inert gas during the cooling and then filled with the gaseous oxidation medium for the oxidation stage.

One advantage of carrying out the gaseous oxidation in the same treatment vessel as that used to form the surface layer is that the conditions of gaseous oxidation can be pre- determined, i.e. closely controlled, so that the oxide form is substantially exclusively $Fe_3O_4$ as a result of which the layer has a uniform dense or deep black colour.

DESCRIPTION OF THE PREFERRED EMBODIMENT

The method may of course be performed in stages, each in an individual treatment vessel, but in such a case extra care must be taken to avoid the presence of other gases which might lead to the formation of other oxides.

The gaseous oxidation may be carried out at any convenient temperature, preferably about 400 to about 650° C., more preferably at about 500° C. The gaseous oxidation medium may comprise oxygen, exothermic gas, steam, nitrogen, CO2, or a mixture of any of these;

preferably the gaseous medium is lean exothermic gas. Preferably the oxidation treatment is carried for a period of about one hour to form a layer consisting exclusively of $Fe_3O_4$ so that the component has a uniform dense or black colour. At the end of the gaseous oxidation, the component is cooled and then released from the treatment vessel.

The surface layer may be formed in a fluidised bed furnace or by a plasma discharge method.

The depth of oxide layer is preferably sufficient to resist the later application of a mechanical surface preparation treatment eg. polishing, lapping or the like. Preferably, the oxide layer is at least 0.2 micron deep and does not exceed 1.0 micron in depth.

The component may be any steel, including carbon steels, nonalloy and alloy steels, and the like.

It is surprising that a dense black appearance can be formed on the component according to the method of the invention given that according to the teachings of GB-A-2180264, the colour was controlled according to the temperature of the oxidising treatment.

In a specific preferred aspect the invention provides a method of manufacturing a corrosion resistant steel component of uniformly black appearance, the method comprising forming an epsilon iron nitride or a carbonitride surface layer on the component, and then applying a surface finish followed by oxidation characterised in that the component is placed in a hot wall vacuum furnace, an inert gas is introduced, the temperature raised to a nitriding or nitrocarburising temperature, the nitriding or nitro- carburising atmosphere is introduced and the component is exposed thereto for a period, the component is cooled to a gaseous oxidation temperature while the vessel is purged of the nitriding or nitrocarburising atmosphere, a gaseous oxidation medium, preferably an exothermic gas, is introduced and the component exposed to the gaseous oxidation medium for a period to form a surface layer which substantially comprises formed of $Fe_3O_4$ only, the component is cooled to ambient temperature in an inert atmosphere, eg. nitrogen, and then given a mechanical surface treatment.

The cooling may be carried out quickly by a conventional quenching method, or slowly in an oxidising or inert atmosphere. These may be performed within or outside the furnace.

The invention includes a corrosion resistant black component manufactured by the method, including one subjected to the later quenching step. A component of the invention has high corrosion resistance and is of a deep black colour, and can be used directly, e.g. without a sealant such as wax or a film of oil.

In order that the invention may be well understood it will now be described by way of illustration only with reference to the following example.

EXAMPLE

A damper rod of 080A37 material according to BS 970 was nitrocarburised in an ammonia based nitrocarburising atmosphere at 610° C. in a hot wall vacuum furnace for 90 minutes. The component in the furnace was cooled to 500° C. during which the nitrocarburising atmosphere was purged using nitrogen. After the temperature was stable at 500° C. the nitrogen atmosphere was quickly replaced by a lean exothermic gas using a pump down and back fill procedure and this gas was held there for about 1 hour to oxidise the surface layer to form $Fe_3O_4$. A dense black layer was formed extending to a depth of 0.5 micron and the colour was a desirable uniform dense black. The furnace and components were cooled to ambient temperature, a nitrogen atmosphere being introduced during the cool down period.

The black damper rod was then removed from the furnace and polished to give a surface finish of 0.4 Um Ra maximum. No paint or wax sealant was applied. The polished, black, corrosion resistant damper rod was subjected to a neutral salt spray test according to ASTM B 117 and no corrosion attack took place after 200 hours of exposure.

What is claimed is:

1. A method of manufacturing a steel component having corrosion resistance, and a uniform dense, deep black color, comprising the steps of sequentially: (a) forming an epsilon iron nitride or carbonitride surface layer on the component, (b) oxidising the component by a gaseous medium at a gas oxidation temperature to form an oxide layer about 0.2 to 1.0 micron thick and comprising substantially $Fe_3O_4$ whereby the component has a uniform dense, deep black color which comprises $Fe_3O_4$, and then (c) carrying out a surface finish treatment, without affecting the uniform dense, deep black color.

2. A method according to claim 1, wherein after the formation of the surface layer, the component is brought to a gas oxidation temperature of from about 400° to about 650° C.

3. A method according to claim 1, wherein the nitriding or nitrocarburising and the gas oxidation are carried out sequentially in the same treatment vessel.

4. A method according to claim 1, wherein the component is cooled from the nitriding or nitrocarburising temperature to ambient temperature and later reheated to the gas oxidation temperature.

5. A method according to claim 1, wherein the gaseous oxidation is carried out in a gaseous medium selected from the group comprising oxygen, exothermic gas, steam, nitrogen, $CO_2$, or a mixture of any of these.

6. A method according to claim 1, wherein the surface finish treatment applied after oxidation is a polish which is carried out until the surface has a maximum roughness of 0.4 micrometers Ra.

7. A method according to claim 1, wherein the nitriding or nitro-carburising is carried out by a technique selected from the group comprising a gaseous technique, or a plasma discharge technique.

8. A method according to claim 1, including the subsequent step of subjecting the component after surface finish treatment to quenching.

9. A method according to claim 3, wherein after the nitriding or nitrocarburising, the vessel is purged of the nitriding or nitrocarburising atmosphere, filled with an inert gas while allowed to cool to the gas oxidation temperature and then filled with the gaseous medium for the oxidation.

10. A method according to claim 5, wherein the gaseous medium is lean exothermic gas.

11. A steel component which has corrosion resistance and a uniform dense, deep black color, in the absence of a sealant or other top cover, wherein the color has been applied to the component by the steps of sequentially: (a) forming an epsilon iron nitride or carbonitride surface layer on the component, (b) oxidising the component by a gaseous medium at a gas oxidation temperature to form a uniform dense, deep black coating which comprises substantially $Fe_3O_4$ having a thickness of about 0.2–1.0 micron, and then (c) carrying out a surface finish treatment without affecting the uniform dense, deep black color.

12. A steel component according to claim 11, wherein the surface has a maximum roughness of 0.4 micrometers Ra.

* * * * *